US006837377B2

(12) United States Patent
Shuert

(10) Patent No.: US 6,837,377 B2
(45) Date of Patent: Jan. 4, 2005

(54) STACKABLE OPEN TOP CONTAINERS

(76) Inventor: Lyle H. Shuert, 70 Kingsley Manor Dr., Bloomfield Hills, MI (US) 48304

( * ) Notice: Subject to any disclaimer, the term of this patent is extended or adjusted under 35 U.S.C. 154(b) by 185 days.

(21) Appl. No.: 10/325,517

(22) Filed: Dec. 19, 2002

(65) Prior Publication Data

US 2004/0118742 A1 Jun. 24, 2004

(51) Int. Cl.[7] ..... B65D 19/00; B65D 19/44

(52) U.S. Cl. ..... 206/599; 206/600; 206/511; 108/55.1

(58) Field of Search ..... 206/595–600; 108/55.1, 56.1

(56) References Cited

U.S. PATENT DOCUMENTS 4,000,704 A * 1/1977 Griffin, Jr. ..... 108/53.1
4,413,737 A * 11/1983 Wind ..... 206/599
4,550,830 A 11/1985 Shuert
4,742,781 A 5/1988 Shuert
4,765,252 A 8/1988 Shuert
4,856,189 A 8/1989 Shuert
4,936,451 A 6/1990 Shuert
4,989,731 A * 2/1991 Shuert ..... 206/386
5,133,460 A 7/1992 Shuert
5,279,423 A 1/1994 Shuert
5,358,137 A 10/1994 Shuert et al.
RE35,875 E * 8/1998 Shuert ..... 108/55.1
5,829,595 A * 11/1998 Brown et al. ..... 206/600
5,857,416 A * 1/1999 Donnell et al. ..... 108/55.3
6,024,223 A * 2/2000 Ritter ..... 206/600

* cited by examiner

*Primary Examiner*—Jacob K. Ackun
*Assistant Examiner*—Faye Francis
(74) *Attorney, Agent, or Firm*—Young & Basile, P.C.

(57) ABSTRACT

A container including a rigid plastic pallet and a tubular sleeve positioned in upstanding fashion on the pallet to form the container. The pallet includes a platform portion adapted to receive a lower edge of the tubular sleeve and a plurality of peripherally spaced hollow legs downstanding from the platform portion and each including a bottom wall. The bottom wall of each leg has an outboard upper level portion and an inboard lower level portion. The upper level portion of each leg has an upper face sized to receive a seat section of the lower edge of the upstanding sleeve and a lower face sized to seat a section of an upper edge of the tubular sleeve of a lower container in a stack of containers. The inboard lower level portions are sized to fit within the upper edge of the lower container sleeve to maintain successive sleeves in a stack of containers in alignment and insure that compressive loading in the sleeves in transferred downwardly to the support surface for the stack. Each sleeve comprises a composite sleeve assembly including inner and outer telescopically arranged sleeve members and each sleeve member comprises a multi-ply corrugated cardboard structure.

20 Claims, 5 Drawing Sheets

STACKABLE OPEN TOP CONTAINERS

BACKGROUND OF THE INVENTION

This invention relates to containers and more particularly to containers of the type including a rigid pallet and a tubular sleeve upstanding from the pallet.

Pallet and sleeve containers are in common usage and may be used for storing either bulk material or discreet free standing articles. In either case it is often necessary or desirable to stack a plurality of loaded containers. The extreme weight imposed in the stack, particularly on lower containers in the stack, makes it necessary to insure that the sleeves, especially of the lower containers, are not damaged by the extreme compressive loading in the stack.

One arrangement to prevent sleeve damage in a container stack has been to provide a rigid plastic lid to fit over the top edge of each sleeve in the stack so that the sleeves of successive containers in the stack remain in alignment and the compressive loading is transferred to the support surface for the stack. In scenarios where a lid is otherwise necessary to protect the container contents the use of the lid does not impose any penalty. However, where a lid is not necessary to protect the contents the need for a lid to allow stacking of the containers complicates the container construction, complicates the container inventory requirements, and imposes a significant cost penalty.

SUMMARY OF THE INVENTION

This invention is directed to an improved container of the type including a pallet and a sleeve upstanding from the pallet.

More particularly this invention is directed to a pallet and sleeve container that may be utilized in a stack of containers without need for a lid over the top edge of the sleeve.

The invention relates to a pallet having a platform portion, adapted to receive the lower edge of a tubular sleeve to form a container, and a plurality of peripherally spaced legs downstanding from the platform portion and each including a bottom.

According to the invention, the bottom of each leg includes an outboard upper level portion sized to seat a section of an upper edge of a lower tubular sleeve and an inboard lower level portion sized to fit within the upper edge of the lower sleeve. With this arrangement, with the upper sleeve positioned on the platform portion to form the container the pallet may be seated on the lower sleeve with the outboard upper level portions of the bottoms of the pallet legs seated on sections of the upper edge of the lower sleeve and the inboard lower level portions of the pallet bottoms positioned snugly within the upper edge of the lower sleeve to maintain the sleeves of successive containers in a stack in alignment.

According to a further feature of the invention, each sleeve comprises a composite sleeve assembly including inner and outer telescopically arranged sleeve members and each sleeve member comprises a multi-ply corrugated cardboard structure. This arrangement enhances the ability of the sleeve to resist distortion in a stacked environment.

According to a further feature of the invention, each leg is hollow and includes a bottom wall defining the bottom of the leg; the outboard upper level portion of each leg bottom comprises an outboard bottom wall upper level portion having upper and lower faces; the lower level portion of each leg bottom comprises an inboard bottom wall lower level portion; the lower edge of the upper sleeve is seated on the upper faces of the outboard bottom wall upper level portions; and the upper edge of the lower sleeve is seated on the lower faces of the outboard bottom wall upper level portions. This arrangement provides a ready and efficient means of seating the upper and lower sleeves in a stacked configuration while maintaining the sleeves of successive containers in a stack in alignment.

According to a further feature of the invention, the lower face of the pallet is configured to define tunnels between the pallet legs and the lower edge of the upstanding sleeve is selectively cut away to define the lower edge seat sections and to further define raised lower edge sections interconnecting the seat sections and spanning the tunnels of the pallet. This arrangement allows the downward compressive forces applied to stacked containers to be transferred by the sleeve substantially directly to the supporting surface thereby minimizing deformation of peripheral portions of the base pallet.

According to a further feature of the invention, the pallet includes corner legs; the upper and lower faces of the outboard upper level bottom wall portions of each corner leg have an L-shaped configuration; the lower edge of the upstanding sleeve is configured to define L-shaped corner seat sections conforming to the configuration of the upper face of the outboard upper level bottom wall portion of the corner leg; and the upper edge of the lower container sleeve is configured to define L-shaped corner portions conforming to the configuration of the lower face of the outboard upper level bottom wall portions of the comer legs. This arrangement maximizes the seating support for the upper and lower sleeves and firmly supports the upper edge of the lower sleeve throughout the entire periphery of the sleeve to maintain sleeve alignment in stacked containers.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
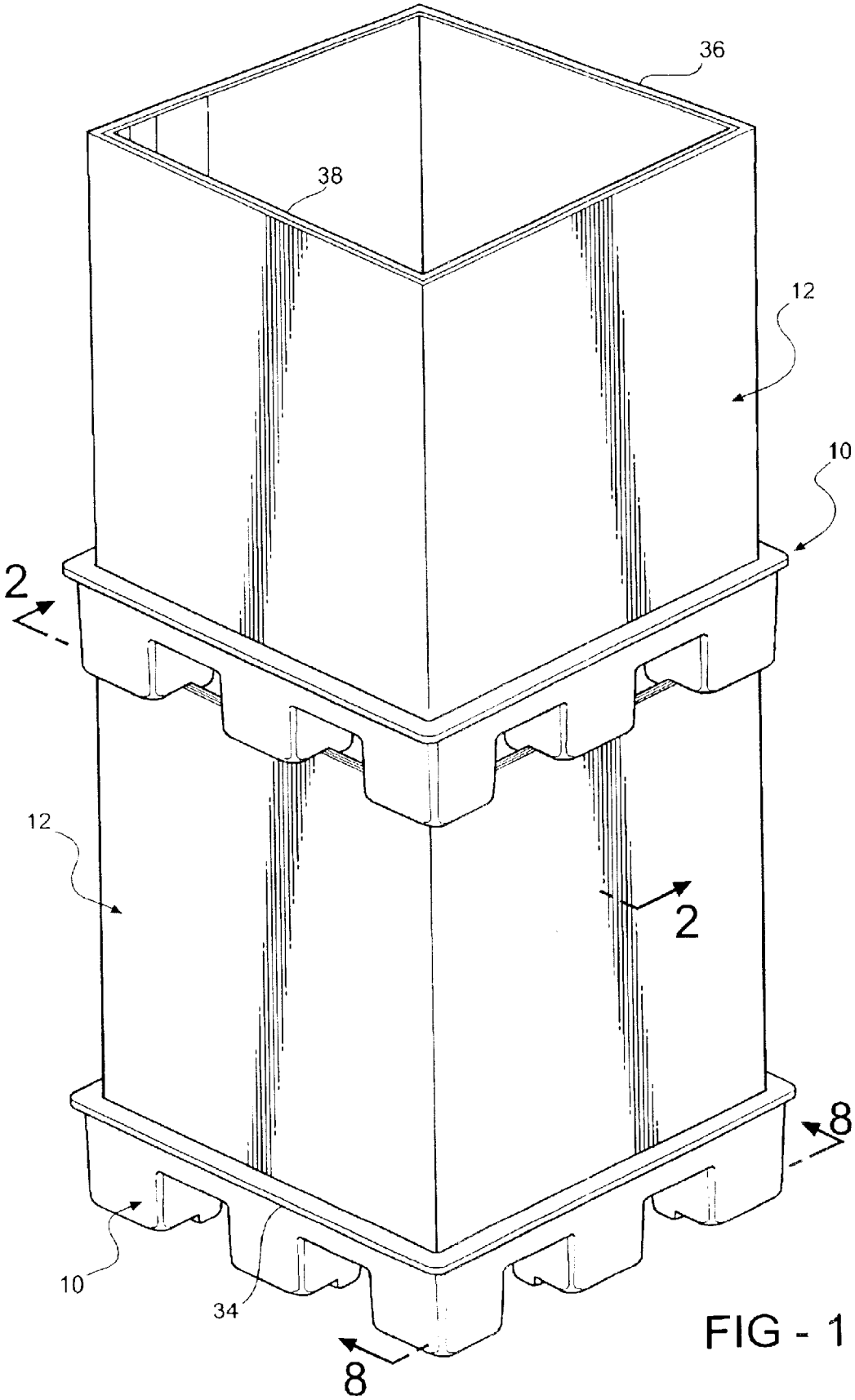
FIG. 1 is a fragmentary perspective view showing containers according to the invention in a stacked configuration.

The container of the invention, broadly considered, includes a pallet 10 and a sleeve 12. Pallet 10 is formed of a rigid plastic material and preferably employs a twin sheet construction including two sheets 14 and 16 of organic polymeric material such as polyethylene which are vacuum formed and fused or knitted together at various points to add structural rigidity. Pallet 10 is generally planar and includes a planar platform structure 18 defining a flat upper load face 20 and a plurality of hollow legs extending downwardly from platform structure 18 and opening in upper face 20. As shown, corner legs 22 are provided at each corner of the pallet, intermediate legs 24 are provided at an intermediate location along each side of the pallet, and a central leg 26 is provided centrally of the pallet.

Legs 22, 24 and 26 will be seen to cooperate to define tunnels or indentations 28 extending transversely and longitudinally across the lower face 30 of the pallet to provide relieved access areas for receiving the forks of a fork lift truck or the like. As a consequence, the container may be lifted and moved by conventional warehousing equipment.

Upper vacuum formed sheet 14 will be seen to form the upper face 20 of the platform structure; lower vacuum formed sheet 16 will be seen to form the lower face 30 of the platform structure; and downwardly extending protrusions of the upper and lower sheets will be seen to be knitted together to form the legs 22, 24 and 26 of the pallet. Upper sheet 14 further includes a plurality of circumferentially spaced upwardly opening U-shaped edge portions 14*a* positioned over each tunnel 28 and coacting to define a plurality of upwardly opening grooves 32 spaced circumferentially around the periphery of the pallet.

Sheets 14 and 16 further coact to define a bottom wall for each leg. Specifically, corner legs 22 include a bottom wall 22*a*; intermediately legs 24 include a bottom wall 24*a*; and center leg 23 includes a bottom wall 26*a*. Bottom wall 26*a* of center leg 26 is planar but the bottom walls of the remaining legs are stepped to define upper level outboard portions and lower level inboard portions.

Specifically, the bottom wall 22*a* of each corner leg 22 includes an outboard upper level portion 22*b* and an inboard lower level portion 22*c* joined by a step or shoulder 22*d*, and the bottom wall 24*a* of each intermediate leg 24 includes an outboard upper level portion 24*b* and an inboard lower level portion 24*c* joined by a step or shoulder 24*d*. The outboard portions 24*b* of the intermediate legs will be seen to have a linear configuration and the outboard portions 22*b* of the corner legs will be seen to have an L-shaped configuration. Sheets 14 and 16 also include outer upwardly extending portions 14*b*, 16*a* fused together to form a continuous rim 34 extending around the periphery of the pallet.

Sleeve assembly 12 is formed of a pair of tubular sleeve members 36 and 38 which are telescopically arranged and suitably secured together, for example, by a suitable adhesive. Each sleeve member is preferably formed of three-ply corrugated material such as is commercially available from Tri-wall Containers, Inc.

Each sleeve member 36, 38 is formed in known manner of a plurality of flat primary cardboard sheets interspersed with an adhesive secured to a plurality of corrugated cardboard sheets with the flat primary sheets disposed on the inner and outer surfaces respectively of each member so as to form a multi-layer sandwich construction.

Sleeve assembly 12 is configured along its lower edge 12*a* to match the configuration of pallet 10. Specifically, a plurality of cut outs 12*b* are provided in circumferentially spaced fashion around the lower peripheral edge of the sleeve assembly to define a plurality of legs including corner legs 12*c* and intermediate legs 12*d* configured to fit respectively within the hollow legs 22 and 24 of the pallet with the upper edges 12*e* at the tops of the cutouts positioned in the grooves 32 defined by the pallet. The sections 12*f* of the lower edge defined by the legs 12*c* will be seen to have an L-shaped configuration conforming generally to the L-shaped configuration of the outboard upper level portions 22*b* of the corner legs 22 and the planar lower edges 12*g* of the legs 12*d* will be seen to have a linear configuration conforming to the linear configuration of the outboard upper level portion 24*a* of the intermediate pallet legs 24.

With sleeve assembly 12 positioned in upstanding fashion on pallet 10, upper cut out edges 12*e* are positioned in grooves 32; the L-shaped lower edge sections 12*f* of the corner sleeve assembly legs 12*c* are seated on the upper faces 22*e* of the outboard upper level portions 22*b* of the corner pallet legs; and the linear lower edge sections 12*g* of the lower edge of the sleeve assembly are seated on the upper face 24*e* of the outboard upper level portions 24*b* of the intermediate pallet legs.

Figure 2:
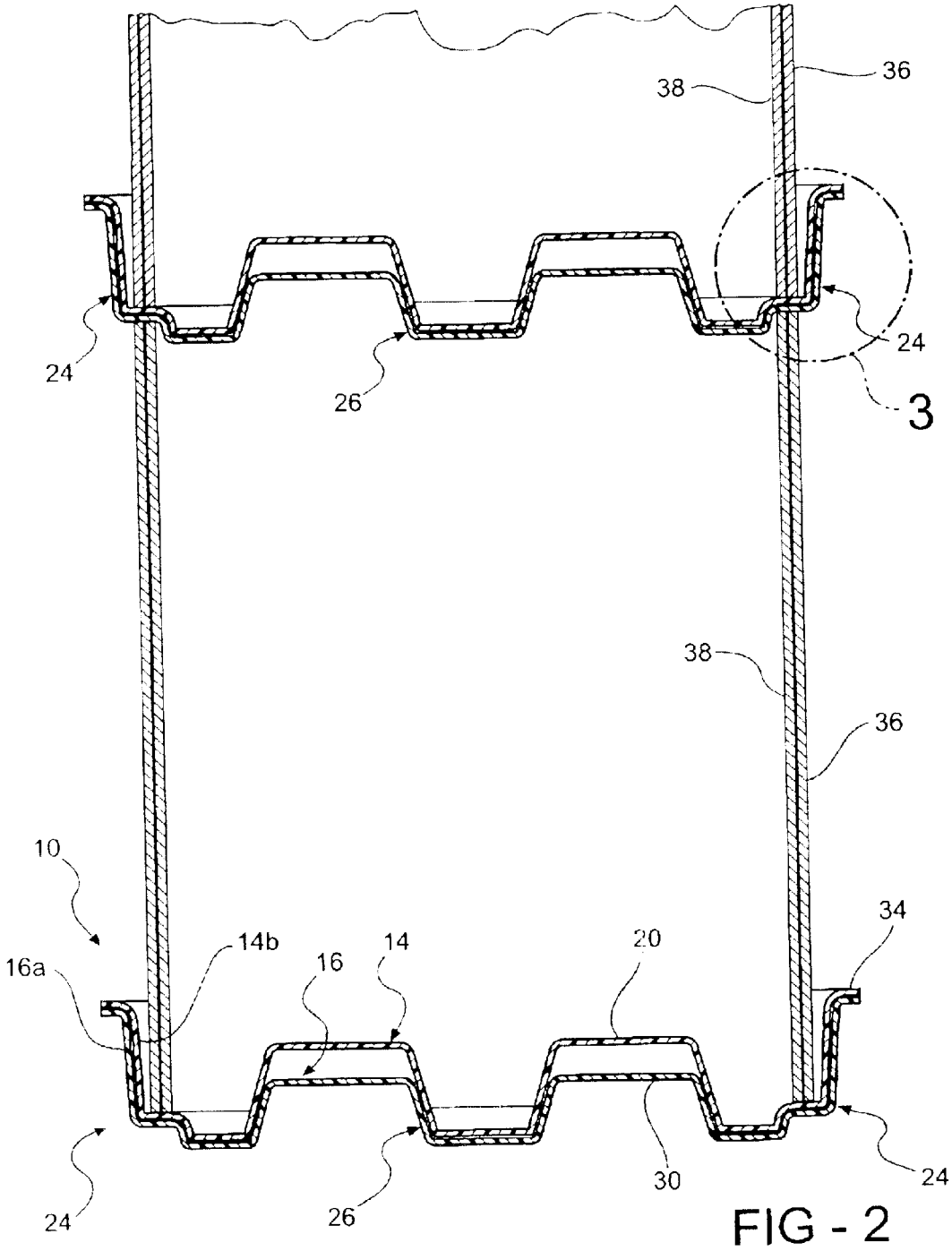
FIG. 2 is a schematic cross-sectional view of the stacked containers of FIG. 1.
Figure 3:
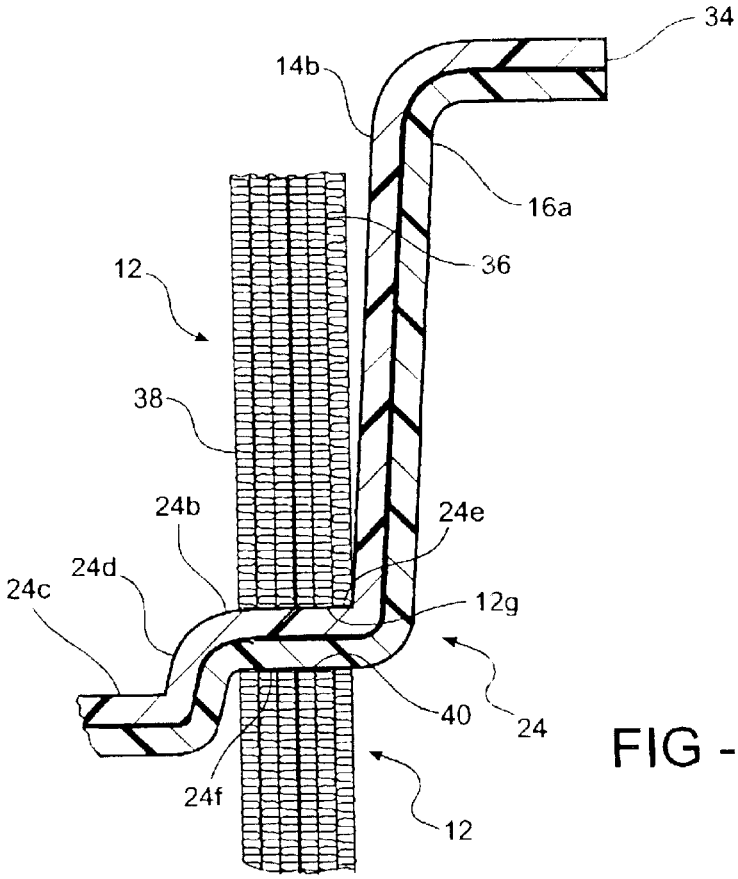
FIG. 3 is a detail view taken within the circle 3 of FIG. 2.
Figure 4:
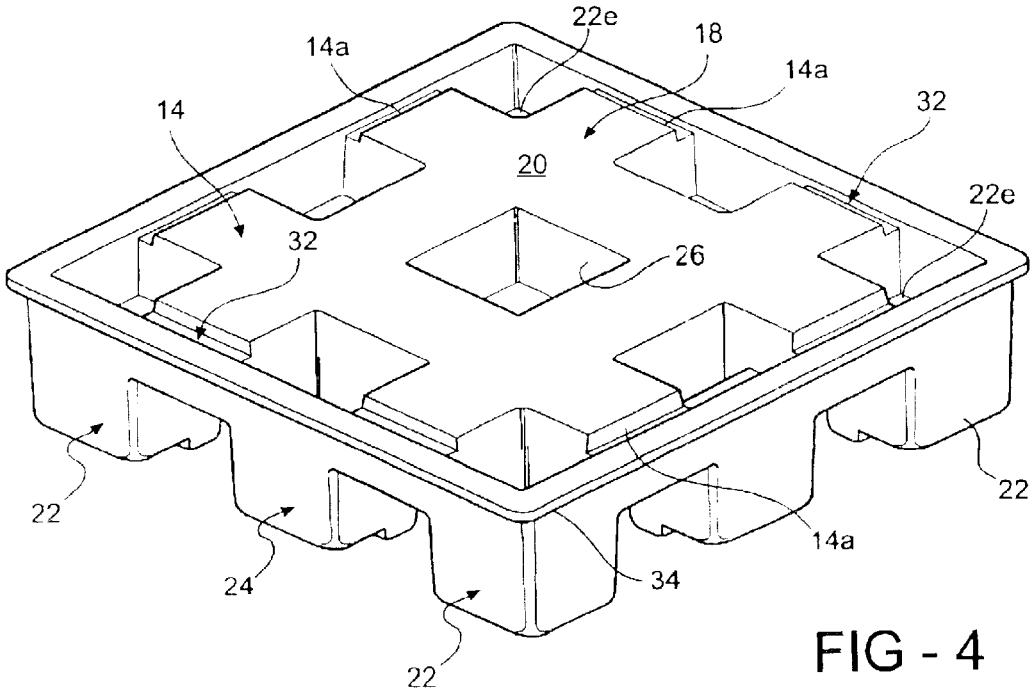
FIG. 4 is a perspective view of a pallet forming a part of the invention container.
Figure 5:
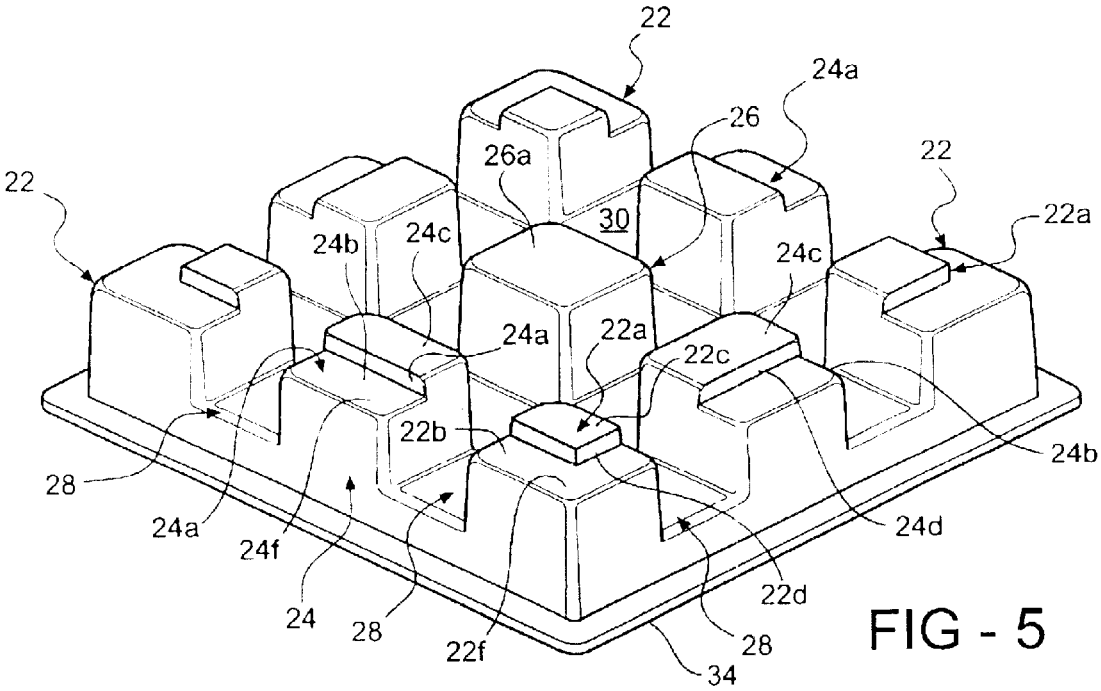
FIG. 5 is a perspective view of an inverted pallet.
Figure 6:
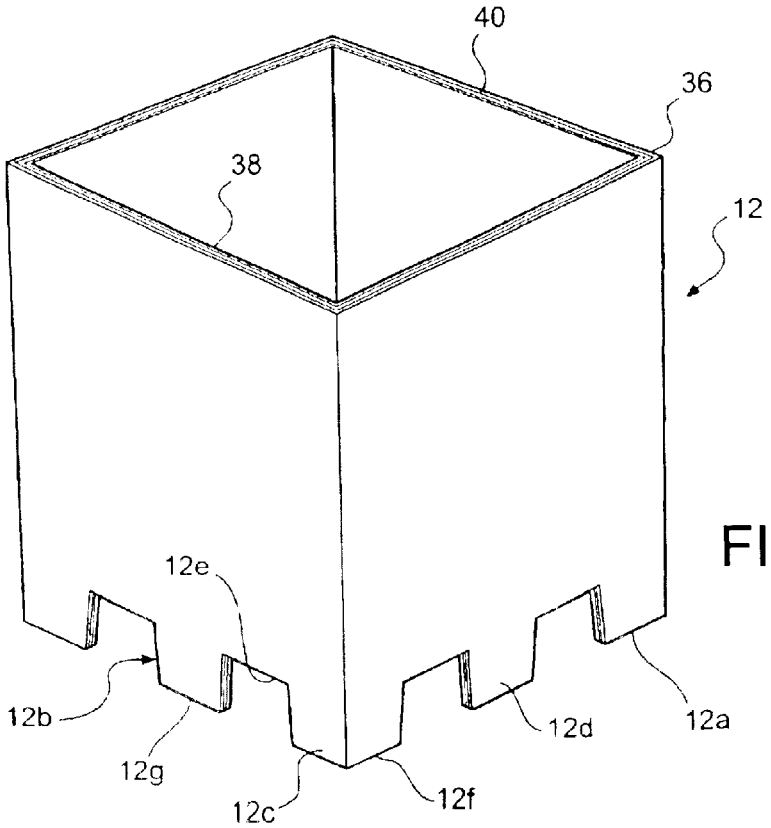
FIG. 6 is a perspective view of a sleeve forming a part of the invention container.
Figure 7:
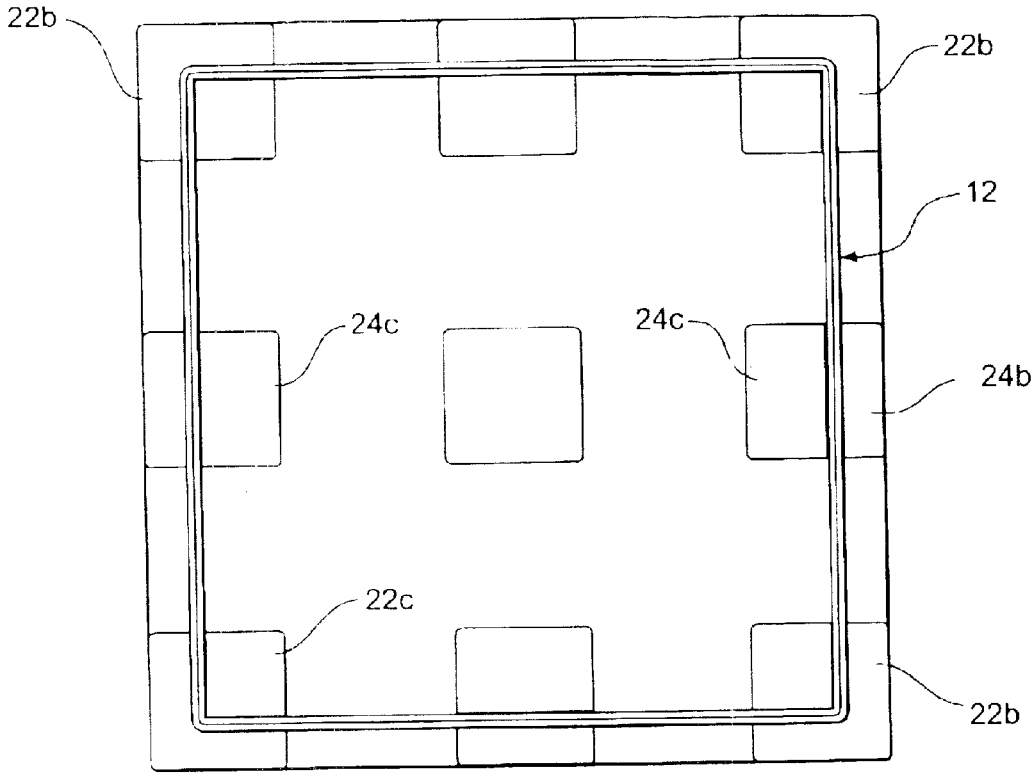
FIG. 7 is a cross-sectional diagrammatic view illustrating the interaction of the pallet and sleeve of the invention container.
Figure 8:
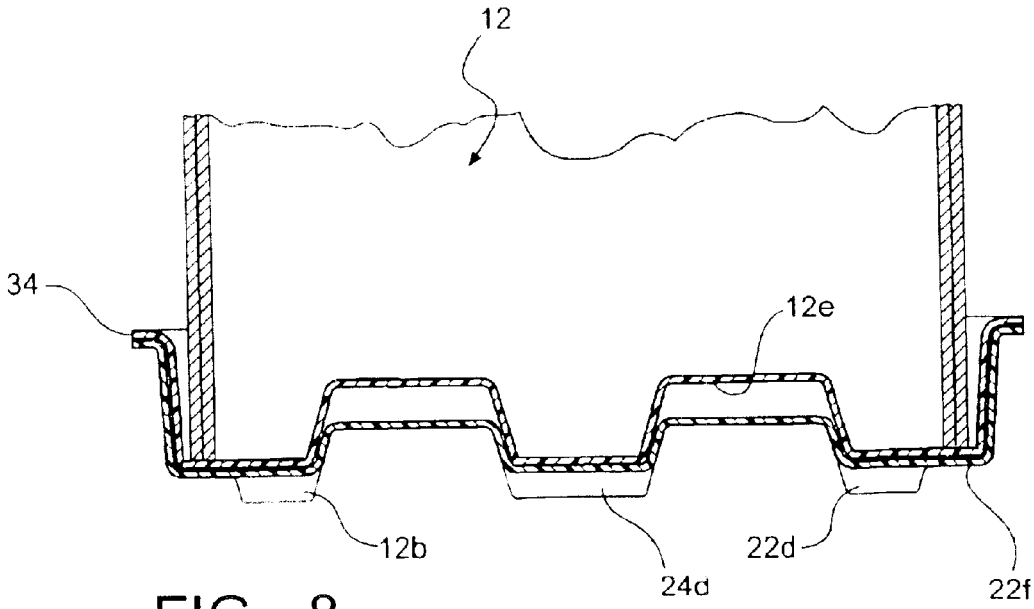
FIG. 8 is a fragmentary, cross-sectional, somewhat diagrammatic view taken on line 8—8 of FIG. 2.

When the invention containers are positioned in a stacked configuration as seen in FIGS. 1, 2 and 3, the outboard upper level portions of the bottom walls of the pallet legs are seated on respective sections of the upper edge 40 of the lower sleeve and the inboard lower level portions of the bottom walls of the pallet legs are positioned snugly within the upper edge 40 of the lower sleeve to maintain the sleeves of successive containers in the stack in alignment whereby to transfer compressive loading in the stack to the support surface for the stack.

Specifically, the L-shaped lower face 22*f* of each pallet corner leg is seated on an L-shaped corner section of the upper edge 40 of the lower sleeve assembly; the linear lower faces 24*f* of the outboard upper level portions of the intermediate legs are seated on circumferentially spaced linear sections of the upper edge 40 of the lower pallet assembly; and the inboard lower level portions 22*c*, 24*c* of the corner and intermediate legs are positioned snugly within the upper edge 40 of the lower sleeve assembly to maintain the sleeves in alignment. It will be understood that the inboard lower level leg portions are dimensioned such that the rectangular outer periphery defined by the combined inboard lower level leg portions corresponds to the inner peripheral configuration of the upper edge of the sleeve assembly so that the inboard lower level portions in combination firmly locate the upper edge of the lower sleeve to maintain sleeve alignment in the stack even when encountering the heavy compressive loading experienced in a stack of loaded containers.

It will be understood that suitable structure may be provided on the sleeves and pallets to releasably secure the sleeves to the pallets. For example, and as shown in U.S. Pat. No. 4,989,731 incorporated herein by reference, sliding latches may be provided at spaced locations around the periphery of each pallet for coaction with slots in the lower edge portion of the associated sleeve.

The invention will be seen to provide a pallet and sleeve container wherein the container may be utilized in a stack of containers without the need to provide an upper lid to maintain alignment of successive sleeves in the stack. It will further be seen that the integrity of a stack of containers is further enhanced by the distortion resistant capability provided by the compound wall composite sleeve assembly including inner and outer telescopically arranged sleeve members each having a multi-ply corrugated cardboard construction.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A pallet having a platform portion, adapted to receive the lower edge of an upper tubular sleeve to form a container, and a plurality of peripherally spaced legs downstanding from the platform portion and each including a bottom, characterized in that:

the bottom of each leg includes an outboard upper level portion sized to seat a section of an upper edge of a lower tubular sleeve and an inboard lower level portion sized to fit within the upper edge of the lower sleeve, whereby with the upper sleeve positioned on the platform portion to form the container the pallet may be seated on the lower sleeve with the outboard upper level portions of the bottoms of the pallet legs seated on sections of the upper edge of the lower sleeve and the inboard lower level portions of the pallet bottoms positioned snugly within the upper edge of the lower sleeve.

2. A pallet according to claim 1 wherein each sleeve comprises a composite sleeve assembly including inner and outer telescopically arranged sleeve members.

3. A pallet according to claim 2 wherein each sleeve member comprises a multi-ply corrugated cardboard structure.

4. A pallet according to claim 1 wherein:

each leg is hollow and includes a bottom wall defining the bottom of the leg;

the outboard upper level portion of each leg bottom comprises an outboard bottom wall upper level portion having upper and lower faces;

the lower level portion of each leg bottom comprises an inboard bottom wall lower level portion;

the lower edge of the upper sleeve is seated on the upper faces of the outboard bottom wall upper level portions; and the upper edge of the lower sleeve is seated on the lower faces of the outboard bottom wall upper level portions.

5. A container adapted to be arranged in a stack of containers and including a rigid pallet having a platform portion and a plurality of peripherally spaced legs downstanding from the platform portion and each including a bottom, and an upstanding tubular sleeve positioned on the platform portion, characterized in that:

the bottom of each leg includes an outboard upper level portion sized to seat a section of an upper edge of a tubular sleeve of a lower container in the stack and a lower level portion sized to fit within the upper edge of the lower container sleeve, whereby with the upstanding sleeve positioned on the platform portion to form the container the pallet may be seated on the lower container sleeve with the upper level portions of the bottoms of the pallet legs seated on sections of the upper edge of the lower container sleeve and the lower level portions of the pallet bottoms positioned snugly within the upper edge of the lower container sleeve.

6. A pallet according to claim 5 wherein each sleeve comprises a composite sleeve assembly including inner and outer telescopically arranged sleeve members.

7. A pallet according to claim 6 wherein each sleeve member comprises a multi-ply corrugated cardboard structure.

8. A pallet according to claim 5 wherein;

each leg is hollow and includes a bottom wall defining the bottom of the leg;

the outboard upper level portion of each leg bottom comprises an outboard bottom wall upper level portion having upper and lower faces;

the lower level portion of each leg bottom comprises an inboard bottom wall lower level portion;

the lower edge of the upstanding sleeve is seated on the upper faces of the outboard bottom wall upper level portions; and the upper edge of the lower container sleeve is seated on the lower faces of the outboard bottom wall upper level portions.

9. A container assembly including a pallet having a platform portion and a plurality of peripherally spaced legs downstanding from the platform portion and each including a bottom, an upper tubular sleeve positioned on and upstanding from the platform portion, and a lower sleeve, characterized in that:

the bottom of each leg includes an outboard upper level portion sized to seat a section of an upper edge of the lower sleeve and a lower level portion sized to fit within the upper edge of the lower sleeve, whereby with the upper sleeve positioned on the platform portion to form the container the pallet may be seated on the lower sleeve with the upper level portions of the bottoms of the pallet legs seated on sections of the upper edge of the lower sleeve and the lower level portions of the pallet bottoms positioned snugly within the upper edge of the lower sleeve.

10. A pallet according to claim 9 wherein each sleeve comprises a composite sleeve assembly including inner and outer telescopically arranged sleeve members.

11. A pallet according to claim 10 wherein each sleeve member comprises a multi-ply corrugated cardboard structure.

12. A pallet according to claim 9 wherein:

each leg is hollow and includes a bottom wall defining the bottom of the leg;

the upper level portion of each leg bottom comprises a bottom wall upper level portion having upper and lower faces;

the lower level portion of each leg bottom comprises a bottom wall lower level portion;

the lower edge of the upper sleeve is seated on the upper faces of the bottom wall upper level portions; and the upper edge of the lower sleeve is seated on the lower faces of the bottom wall upper level portions.

13. A container adapted to be arranged in a stack of containers and including:

a tubular upstanding sleeve; and a pallet having a platform portion, adapted to receive a lower edge of the tubular sleeve to form the container, and a plurality of peripherally spaced hollow legs downstanding from the platform portion and each including a bottom wall having an outboard upper level portion having an upper face sized to seat a section of the lower edge of the upstanding sleeve and a lower face sized to seat a section of an upper edge of the tubular sleeve of a lower container in the stack, and an inboard lower level portion sized to fit within the upper edge of the lower sleeve, whereby with the upper sleeve positioned on the platform portion to form the container, the pallet may be seated on the lower sleeve with the outboard upper level portions of the bottoms of the pallet legs seated on sections of the upper edge of the lower sleeve and the inboard lower level portions of the pallet bottoms positioned snugly within the upper edge of the lower sleeve.

14. A container according to claim 13 wherein each sleeve comprises a composite sleeve assembly including inner and outer telescopically arranged sleeve members.

15. A container according to claim 14 wherein each sleeve member comprises a multi-ply corrugated cardboard structure.

16. A container according to claim 13 wherein:

the lower face of the pallet is configured to define tunnels between the pallet legs; and the lower edge of the upstanding sleeve is selectively cut away to define the seated lower edge sections and to further define raised lower edge sections interconnecting the seated sections and spanning the tunnels of the pallet.

17. A container according to claim 16 wherein each sleeve member comprises a composite sleeve assembly including inner and outer telescopically arranged sleeve members.

18. A container according to claim 17 wherein each sleeve member comprises a multi-ply corrugated cardboard structure.

19. A container according to claim 16 wherein:

the pallet includes corner legs;

the upper and lower faces of the outboard upper level bottom wall portions of each corner leg have an L-shaped configuration;

the lower edge of the upstanding sleeve is configured to define L-shaped corner seat sections conforming to the configuration of the upper face of the outboard upper level bottom wall portions of the corner legs;

the container further includes the lower container sleeve; and the upper edge of the lower container sleeve is configured to define L-shaped corner portions conforming to the configuration of the lower face of the outboard upper level bottom wall portions of the corner legs.

20. A container according to claim 19 wherein:

each sleeve comprises a composite sleeve assembly including inner and outer telescopically arranged sleeve members; and each sleeve member comprises a multi-ply corrugated cardboard structure.

* * * * *